US012674363B2

(12) United States Patent
Li et al.

(10) Patent No.: US 12,674,363 B2
(45) Date of Patent: Jul. 7, 2026

(54) PIPE CLAMPING MECHANISM AND ROBOT FOR OIL AND GAS DRILLING

(71) Applicant: Beijing JJC Technology Co., Ltd, Beijing (CN)

(72) Inventors: Xuejun Li, Beijing (CN); Hailong Huang, Beijing (CN); Feng Yan, Beijing (CN); Wei Chen, Beijing (CN); Wenqiang Fu, Beijing (CN); Haixu Li, Beijing (CN)

(73) Assignee: Beijing JJC Technology Co., Ltd, Beijing (CN)

( * ) Notice: Subject to any disclaimer, the term of this patent is extended or adjusted under 35 U.S.C. 154(b) by 0 days.

(21) Appl. No.: 18/969,310

(22) Filed: Dec. 5, 2024

(65) Prior Publication Data

US 2025/0179883 A1 Jun. 5, 2025

(30) Foreign Application Priority Data

| | | |
|---|---|---|
| Dec. 5, 2023 | (CN) | 202311655890.5 |
| Dec. 5, 2023 | (CN) | 202323305231.7 |
| Apr. 28, 2024 | (CN) | 202410523306.9 |

(51) Int. Cl.
*E21B 19/14* (2006.01)
*E21B 19/02* (2006.01)

(52) U.S. Cl.
CPC ..... *E21B 19/02* (2013.01)

(58) Field of Classification Search
CPC ..... E21B 19/02; E21B 19/14; E21B 19/155
USPC ..... 414/22.51–22.71; 294/102.1, 102.2, 294/93–96
See application file for complete search history.

(56) References Cited

U.S. PATENT DOCUMENTS

| | | | | |
|---|---|---|---|---|
| 3,937,514 | A * | 2/1976 | Langowski | E21B 19/14 294/90 |
| 4,397,605 | A * | 8/1983 | Cowgill | E21B 19/14 294/203 |
| 8,961,093 | B2 * | 2/2015 | Springett | E21B 19/20 414/22.68 |
| 10,465,455 | B2 * | 11/2019 | Berry | E21B 19/14 |
| 2018/0328123 | A1 * | 11/2018 | Keogh | E21B 19/14 |
| 2019/0119995 | A1 * | 4/2019 | Gullaksen | E21B 19/155 |

* cited by examiner

*Primary Examiner* — Lynn E Schwenning
(74) *Attorney, Agent, or Firm* — Bayramoglu Law Offices LLC

(57) ABSTRACT

The provided is a pipe clamping mechanism for oil and gas drilling and a robot using same. The pipe clamping mechanism includes a housing, a baffle, a clamping assembly, a transmission assembly, a driving assembly, and an opening and closing assembly, where the housing is provided with a pipe clamping channel; the baffle is rotatably provided on the housing; the driving assembly and the opening and closing assembly are provided on the housing; the driving assembly is connected to the opening and closing assembly through the transmission assembly; the opening and closing assembly is connected in a transmission manner to the baffle; the clamping assembly is movable forward and backward on the housing; the driving assembly is connected to the clamping assembly through the transmission assembly; the driving assembly is configured to drive, through the transmission assembly, the clamping assembly to move forward and backward.

15 Claims, 11 Drawing Sheets

PIPE CLAMPING MECHANISM AND ROBOT FOR OIL AND GAS DRILLING

CROSS-REFERENCE TO THE RELATED APPLICATIONS

This application is based upon and claims priority to Chinese Patent Application No. 202311655890.5, filed on Dec. 5, 2023; Chinese Patent Application No. 202323305231.7, filed on Dec. 5, 2023; and Chinese Patent Application No. 202410523306.9, filed on Apr. 28, 2024, the entire contents of which are incorporated herein by reference.

TECHNICAL FIELD

The present disclosure relates to the technical field of oil and gas drilling, and in particular to a pipe clamping mechanism and a robot for oil and gas drilling.

BACKGROUND

In the drilling process of an oil drilling rig, a derrick is a device used to place crown blocks, hang traveling blocks, hooks, elevator links, elevators, and other equipment, as well as to trip and store pipes, tubing, and sucker rods. The derrick includes a main body, a crown block platform, a crown block frame, a racking platform, a riser fingerboard, and a working ladder. The racking platform is a workplace for derrickmen to perform tripping operations, and it includes a monkey board for derrickmen to work and a fingerboard for storing pipes. As a type of rod used for connection and power transmission among drilling tools, pipes are important components for oil drilling.

In practical use, the pipes are long and heavy and need to be held by a clamping mechanism to maintain stability. The diameter of different types of pipes varies, and traditional clamping mechanisms often have poor compatibility with different types of pipes. In addition, due to the limited space of the racking platform and the need to store a large number of pipes, the pipes are densely stored, resulting in a small working space for grabbing or arranging pipes. Traditional clamping mechanisms require at least two actions, namely opening and closing, which occupy a large amount of space and may touch other pipes during the process of grabbing or arranging pipes, affecting work efficiency and easily damaging pipes.

SUMMARY

(I) Technical Problem to be Solved

Given the above-mentioned drawbacks and shortcomings of the prior art, the present disclosure provides a pipe clamping mechanism and a robot for oil and gas drilling. The present disclosure solves the technical problems that the prior art has poor compatibility with different types of pipes and faces low work efficiency and easy damage to pipes during the process of grabbing or arranging pipes.

(II) Technical Solution

To achieve the above objective, the present disclosure adopts the following technical solutions:

An aspect of the present disclosure provides a pipe clamping mechanism for oil and gas drilling, including a housing, a baffle, a clamping assembly, a transmission assembly, a driving assembly, and an opening and closing assembly, where the housing is provided with a pipe clamping channel extending in a front-to-rear direction; the baffle is rotatably provided on the housing; the driving assembly and the opening and closing assembly are provided on the housing; the driving assembly is connected to the opening and closing assembly through the transmission assembly; the opening and closing assembly is connected in a transmission manner to the baffle; the clamping assembly is movable forward and backward on the housing; the driving assembly is connected to the clamping assembly through the transmission assembly; the driving assembly is configured to drive, through the transmission assembly, the clamping assembly to move forward and backward, and simultaneously drive the opening and closing assembly to rotate the baffle in a vertical plane, thereby opening or closing the clamping channel; and the housing is provided on a robotic arm assembly.

Optionally, the clamping assembly includes a slider mounting seat, a tong plate assembly, and a reset assembly; the slider mounting seat is slidable forward and backward inside the housing; the slider mounting seat is connected to the transmission assembly; a front end of the slider mounting seat is provided with a mounting groove that inclines backwards from top to bottom; the tong plate assembly is provided with a mounting surface that inclines backwards from top to bottom; the mounting surface matches the mounting groove in terms of inclination angle; the tong plate assembly is slidably provided in the mounting groove through the mounting surface; and the reset assembly is provided between the mounting groove and the tong plate assembly to provide an upward acting force along the mounting groove to the tong plate assembly when the tong plate assembly slides downwards along the mounting groove, such that after clamping work is completed, the tong plate assembly returns to an initial position.

Optionally, an adaptive assembly is provided between the slider mounting seat and the transmission assembly to perform displacement compensation between the tong plate assembly and a pipe when the pipe tilts.

Optionally, the adaptive assembly includes a connecting rod, a stopper, a thrust joint bearing, and multiple disc springs; the stopper is located between the transmission assembly and the slider mounting seat; the connecting rod is threaded through the stopper and connects the transmission assembly and the slider mounting seat; the thrust joint bearing and the multiple disc springs are sleeved on the connecting rod; the thrust joint bearing is located between the stopper and the slider mounting seat; and the multiple disc springs are located between the stopper and the transmission assembly.

Optionally, the tong plate assembly includes a support and at least one tong plate; two tong plates are provided on the support; the support is provided in the mounting groove; and the reset assembly is provided between the mounting groove and the support.

Optionally, the transmission assembly includes a moving element and a push rod; the moving element is connected to the clamping assembly through the push rod; the moving element is movable forward and backward on the driving assembly; and the driving assembly is configured to drive the moving element to move the clamping assembly forward and backward through the push rod.

Optionally, the baffle rotating shaft is rotatably provided on the housing, with an axis of rotation oriented laterally; one end of the baffle rotating shaft is connected to the baffle; the transmission assembly is connected to the baffle rotating shaft through the lever connecting frame; the driving assembly is configured to drive, through the transmission assembly, the lever connecting frame to move forward and backward; and the lever connecting frame is configured to drive, through the baffle rotating shaft, the baffle to rotate in the vertical plane.

Optionally, the baffle rotating shaft is provided with a limit groove extending along an axial direction; the limit groove includes a linear groove and a quadrant spiral groove that communicate with each other; the lever connecting frame is slidably connected inside the limit groove; the driving assembly is configured to drive, through the transmission assembly, the lever connecting frame to move forward and backward; and when the lever connecting frame slides along the linear groove to the spiral groove, the lever connecting frame drives the baffle rotating shaft to rotate.

Another aspect of the present disclosure provides a robot for oil and gas drilling, including the above-mentioned pipe clamping mechanism and a robotic arm assembly, where the housing of the pipe clamping mechanism is provided on the robotic arm assembly.

Another aspect of the present disclosure further provides a robot for oil and gas drilling, including the above-mentioned pipe clamping mechanism, a telescopic arm assembly, a moving and rotation assembly, and a lifting monkey board assembly, where the housing is provided at one end of the telescopic arm assembly, and the other end of the telescopic arm assembly is movable horizontally at a bottom of the lifting monkey board assembly through the moving and rotation assembly; the lifting monkey board assembly is configured to drive, through the moving and rotation assembly, the telescopic arm assembly to move up or down vertically; and the lifting monkey board assembly is provided on a derrick.

(III) Beneficial Effects

The present disclosure has the following beneficial effects:

In the pipe clamping mechanism for oil and gas drilling provided by the present disclosure, when the clamping assembly is in an initial position, the baffle is in a vertical state, that is, the clamping channel of the housing is in an open state. When in use, according to the position of a pipe, the robotic arm assembly approaches the pipe until the pipe fully enters the clamping channel. The driving assembly drives the clamping assembly forward through the transmission assembly to approach the pipe. Meanwhile, the transmission assembly drives the baffle to rotate from a vertical state to a horizontal state in the vertical plane through the opening and closing assembly so as to close the clamping channel. Then, the driving assembly continues to drive the clamping assembly forward to abut against a rear side of the pipe, thereby pushing the pipe and make a front side of the pipe abut against the baffle. Thus, the pipe is clamped. Compared to the prior art, the pipe clamping mechanism does not require the two actions of opening and closing when clamping the pipe. The robotic arm assembly transfers the pipe clamping mechanism until the pipe enters the clamping channel. The driving assembly drives the baffle to close the clamping channel and drives the clamping assembly to approach and abut against the pipe. The baffle and the clamping assembly clamp the pipe from front and rear sides, achieving one-stretch operations of placing the pipe into position, closing, and clamping. The design features a reasonable and compact structure and very small space occupation, avoids touching other pipes during the process of grabbing or arranging pipes, and is compatible with various specifications of pipes.

In the robot for oil and gas drilling provided by the present disclosure, the lifting monkey board assembly is provided on the derrick to replace the monkey board of a traditional racking platform. The telescopic arm assembly can horizontally move at the bottom of the lifting monkey board assembly through the moving and rotation assembly, without occupying the working space on the lifting monkey board assembly. The moving and rotation assembly achieves horizontal movement and angular rotation of the telescopic arm assembly. The lifting monkey board assembly can drive the telescopic arm assembly to move up or down vertically, allowing maintenance personnel to directly perform maintenance on the lifting monkey board assembly. The lifting monkey board assembly can also reduce the working height to improve convenience. Compared to the prior art, the multifunctional robot can make reasonable use of the limited space on the monkey board without affecting its use and fully meeting the requirements of angle and vertical and horizontal displacement. It is convenient for on-site maintenance in the later stage and achieves a simple and compact structure. In addition, the lifting monkey board assembly can directly replace the monkey board of the traditional racking platform, which is suitable for the transformation of new and old oil drilling rigs.

Figure 1:
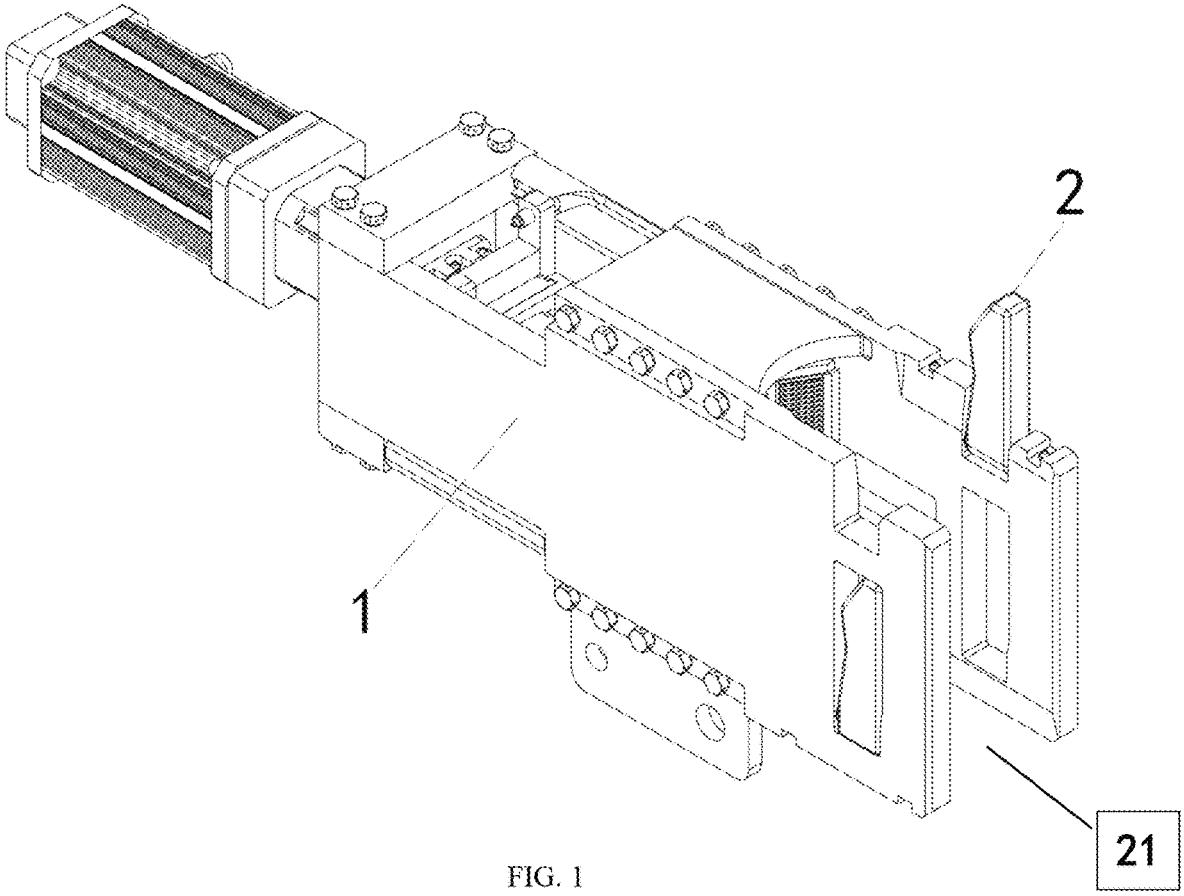
FIG. 1 is an overall structural diagram of a pipe clamping mechanism for oil and gas drilling according to Embodiment 1 of the present disclosure.

REFERENCE NUMERALS 1. housing; 12. sliding mechanism; 121. slide rail; 122. sliding seat; 123. sliding driver; and 13. push-support clamp mechanism;
2. baffle; and 21. pipe clamping channel;
3. clamping assembly; 30. adaptive assembly; 31. slider mounting seat; 311. mounting groove; 32. connecting rod; 33. stopper; 34. thrust joint bearing; 35. disc spring; 36. support; 361. mounting surface; 37. tong plate; 38. tong plate assembly; and 39. reset assembly;
4. transmission assembly; 41. moving element; and 42. push rod;
5. opening and closing assembly; 51. lever connecting frame; 52. baffle rotating shaft; and 53. limit groove; 531. linear groove; and 532. spiral groove;
6. driving assembly; 61. driver; and 62. driving element;
7. telescopic arm assembly; 71. support; 72. telescopic front arm; 73. telescopic rear arm; and 74. telescopic driver;
8. moving and rotation assembly; 81. traveling support; 82. traveling driver; 83. traveling roller; and 84. rotary driver; and
9. lifting monkey board assembly; 91. monkey board; 92. standing post; 93. lifting seat; 94. lift driving assembly; 95. guide rail; and 96. rack.

DETAILED DESCRIPTION OF THE EMBODIMENTS

In order to facilitate a better understanding of the above technical solutions, the exemplary embodiments of the present disclosure are described in more detail below with reference to the drawings. Although the drawings show exemplary embodiments of the present disclosure, it should be understood that the present disclosure may be implemented in various forms and should not be limited to the embodiments set forth herein. The embodiments are provided for a more thorough understanding of the present disclosure, so as to make the scope of the present disclosure be fully conveyed to those skilled in the art. The terms "front" and "rear" mentioned herein are based on the orientations shown in FIG. 2.

Embodiment 1

Figure 2:
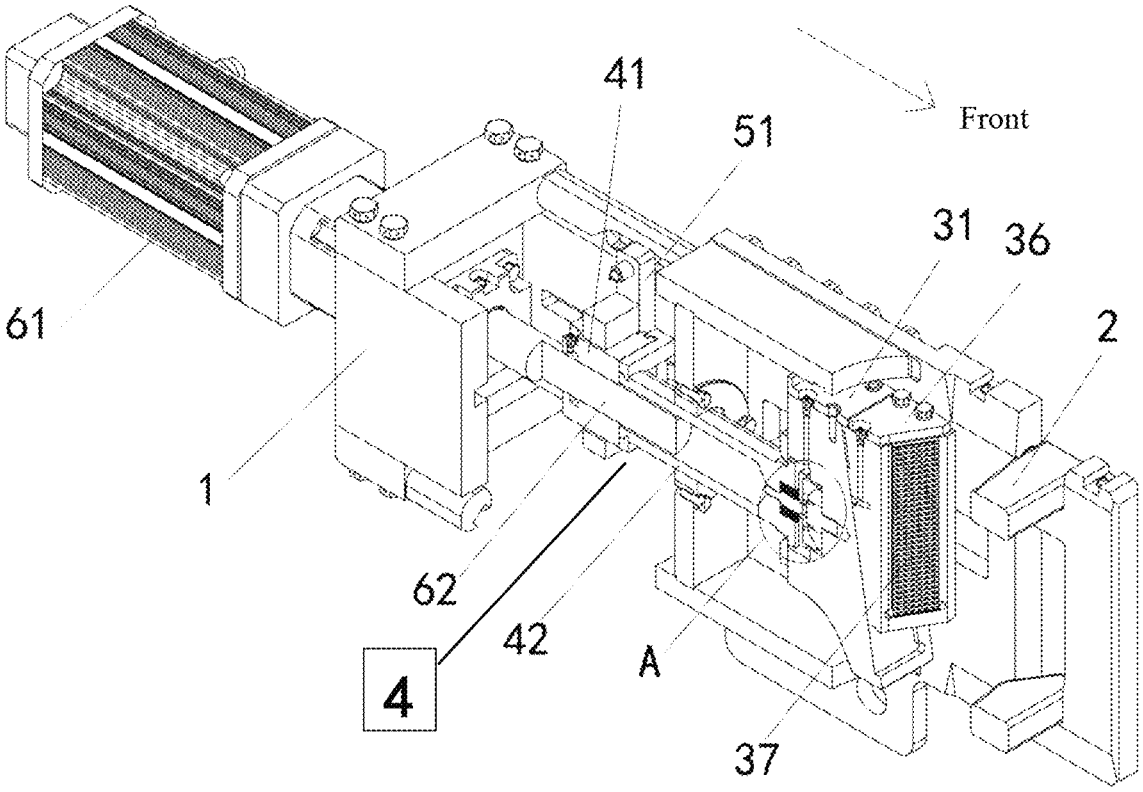
FIG. 2 is a section view of the pipe clamping mechanism for oil and gas drilling according to Embodiment 1 of the present disclosure.

As shown in FIGS. 1 and 2, this embodiment provides a pipe clamping mechanism for oil and gas drilling, including housing 1, baffle 2, a clamping assembly 3, a transmission assembly 4, a driving assembly 6, and an opening and closing assembly 5. The housing 1 is provided with a pipe clamping channel 21 extending in a front-to-rear direction. The baffle 2 is rotatably provided on the housing 1. The driving assembly 6 and the opening and closing assembly 5 are provided on the housing 1. The driving assembly 6 is connected to the opening and closing assembly 5 through the transmission assembly 4. The opening and closing assembly 5 is connected in a transmission manner to the baffle 2. The clamping assembly 3 is movable forward and backward on the housing 1. The driving assembly 6 is connected to the clamping assembly 3 through the transmission assembly 4. The driving assembly 6 is configured to drive, through the transmission assembly 4, the clamping assembly 3 to move forward and backward, and simultaneously drive the opening and closing assembly 5 to rotate the baffle 2 in a vertical plane, thereby opening or closing the clamping channel. The housing 1 is provided on a robotic arm assembly.

Specifically, when the clamping assembly 3 is in an initial position, the baffle 2 is in a vertical state, that is, the clamping channel of the housing 1 is in an open state. When in use, according to the position of a pipe, the robotic arm assembly approaches the pipe until the pipe fully enters the clamping channel. The driving assembly 6 drives the clamping assembly 3 forward through the transmission assembly 4 to approach the pipe. The axial direction of the pipe is vertical. Meanwhile, the transmission assembly 4 drives the baffle 2 to rotate from a vertical state to a horizontal state in the vertical plane through the opening and closing assembly 5 so as to close the clamping channel. Then, the driving assembly 6 continues to drive the clamping assembly 3 forward to abut against a rear side of the pipe, thereby pushing the pipe and make a front side of the pipe abut against the baffle 2. Thus, the pipe is clamped. Compared to the prior art, the pipe clamping mechanism does not require the two actions of opening and closing when clamping the pipe. The robotic arm assembly transfers the pipe clamping mechanism until the pipe enters the clamping channel. The driving assembly 6 drives the baffle 2 to close the clamping channel and drives the clamping assembly 3 to approach and abut against the pipe. The baffle 2 and the clamping assembly 3 clamp the pipe from front and rear sides, achieving one-stretch operations of placing the pipe into position, closing, and clamping. The design features a reasonable and compact structure and very small space occupation, avoids touching other pipes during the process of grabbing or arranging pipes, and is compatible with various specifications of pipes.

Figure 5:
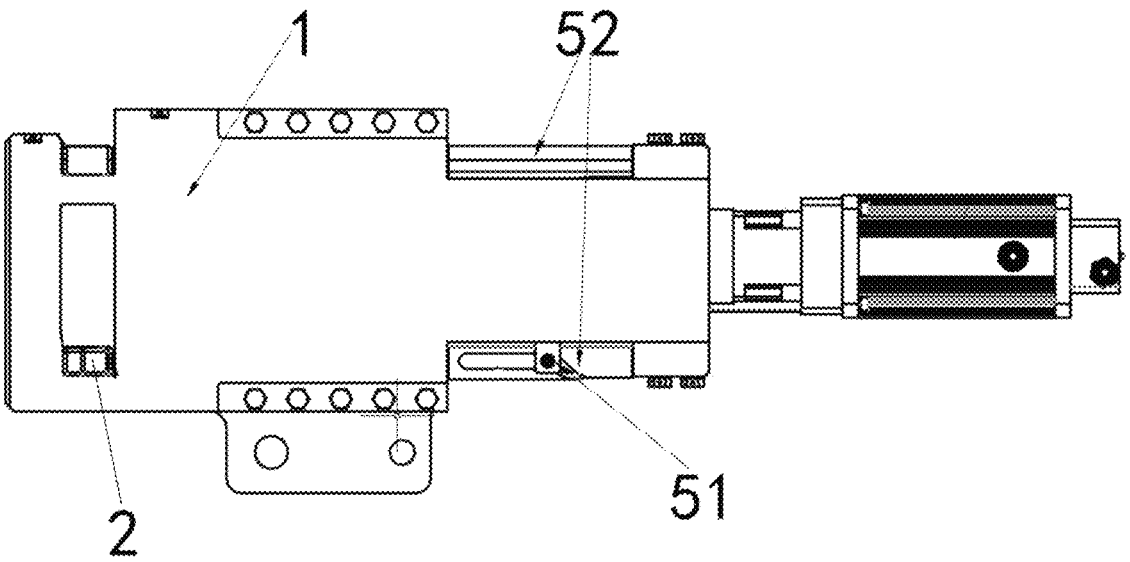
FIG. 5 is a front view of the pipe clamping mechanism for oil and gas drilling according to Embodiment 1 of the present disclosure.
Figure 6:
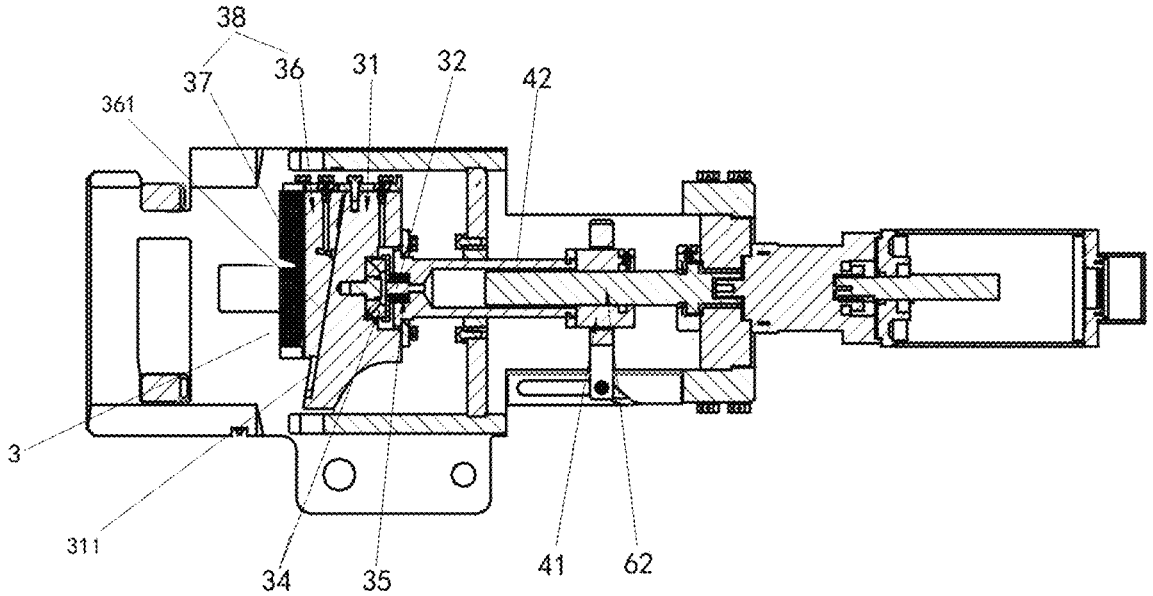
FIG. 6 is a front section view of the pipe clamping mechanism for oil and gas drilling according to Embodiment 1 of the present disclosure.
Figure 7:
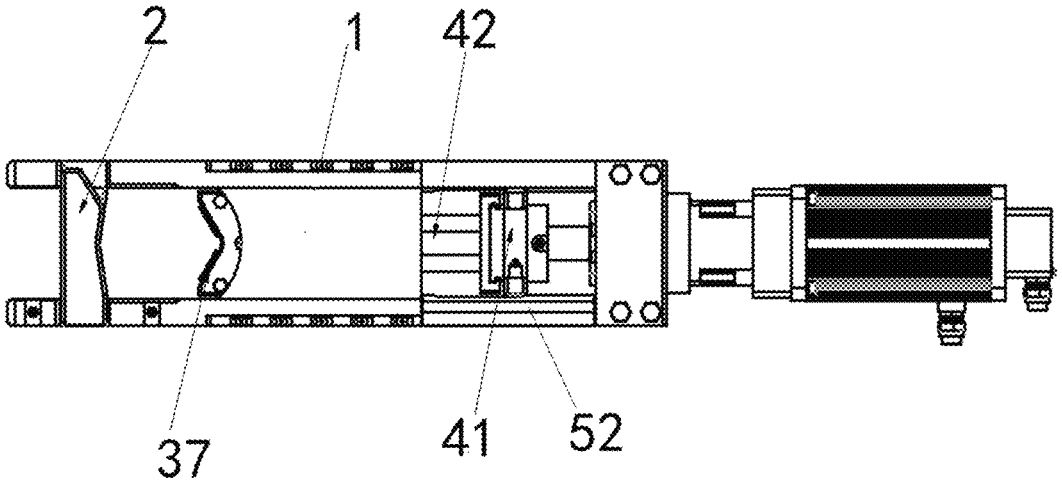
FIG. 7 is a top view of the pipe clamping mechanism for oil and gas drilling according to Embodiment 1 of the present disclosure.

Furthermore, as shown in FIGS. 2 and 5, the clamping assembly 3 includes slider mounting seat 31, a tong plate assembly 38, and a reset assembly 39. The slider mounting seat 31 is slidable forward and backward inside the housing 1. The slider mounting seat 31 is connected to the transmission assembly 4. A front end of the slider mounting seat 31 is provided with a mounting groove 311 that inclines backwards from top to bottom. The tong plate assembly 38 is provided with a mounting surface 361 that inclines backwards from top to bottom. The mounting surface 361 matches the mounting groove 311 in terms of inclination angle. The tong plate assembly 38 is slidably provided in the mounting groove 311 through the mounting surface 361. Specifically, as shown in FIGS. 2 and 6, the tong plate assembly 38 includes support 36 and at least two tong plates 37. The two tong plates 37 are provided on the support 36. The support 36 is provided in the mounting groove 311. The reset assembly 39 is provided between the mounting groove 311 and the support 36. The two tong plates 37 are arranged in a V-shape on the support 36, with a V-shaped opening facing forward to tightly adhere to an outer wall of the clamped pipe. A pipe clamping surface of each of the tong plates 37 is uniformly provided with tongs. The tongs improve the stability of clamping the pipe with a smooth surface and prevent pipe detachment. The reset assembly 39 is provided between the mounting groove 311 and the tong plate assembly 38 to provide an upward acting force along the mounting groove 311 to the tong plate assembly 38 when the tong plate assembly 38 slides downwards along the mounting groove 311. After the clamping work is completed, the tong plate assembly 38 returns to the initial position. In this embodiment, the reset assembly 39 includes two clamp lift springs. Two ends of each of the two clamp lift springs are respectively provided in the mounting groove 311 and the support 36 and are located between the mounting groove 311 and the support 36. Thus, the tong plate assembly 38 serves as a wedge, and the driving assembly 6 drives the slider mounting seat 31 to drive the tong plate assembly 38 to abut against the rear side of the pipe, while the baffle 2 abuts against the front side of the pipe. Then, the robotic arm assembly drives the mechanism to rise as a whole. The tong plate assembly 38 begins to slide downwards along the mounting groove 311. The two clamp lift springs are compressed, further reducing the distance between the tong plate assembly 38 and the baffle 2. The clamping force applied by the tong plate assembly 38 and the baffle 2 to the pipe increases, and the frictional force between the tong plate assembly 38 as well as the baffle 2 and the pipe also increases, thereby clamping the pipe. When the pipe is released, the driving assembly 6 drives the slider mounting seat 31 to move backwards, thereby driving the baffle to open the clamping channel. The tong plate assembly 38 detaches from the pipe, and slides upward along the mounting groove 311 under the action of the two clamp lift springs to reset. The tong plate assembly 38 forms a wedge-shaped self-locking method for clamping the pipe, and when the pipe detaches, it can automatically release and reset without interfering with the pipe's detachment.

Figure 3:
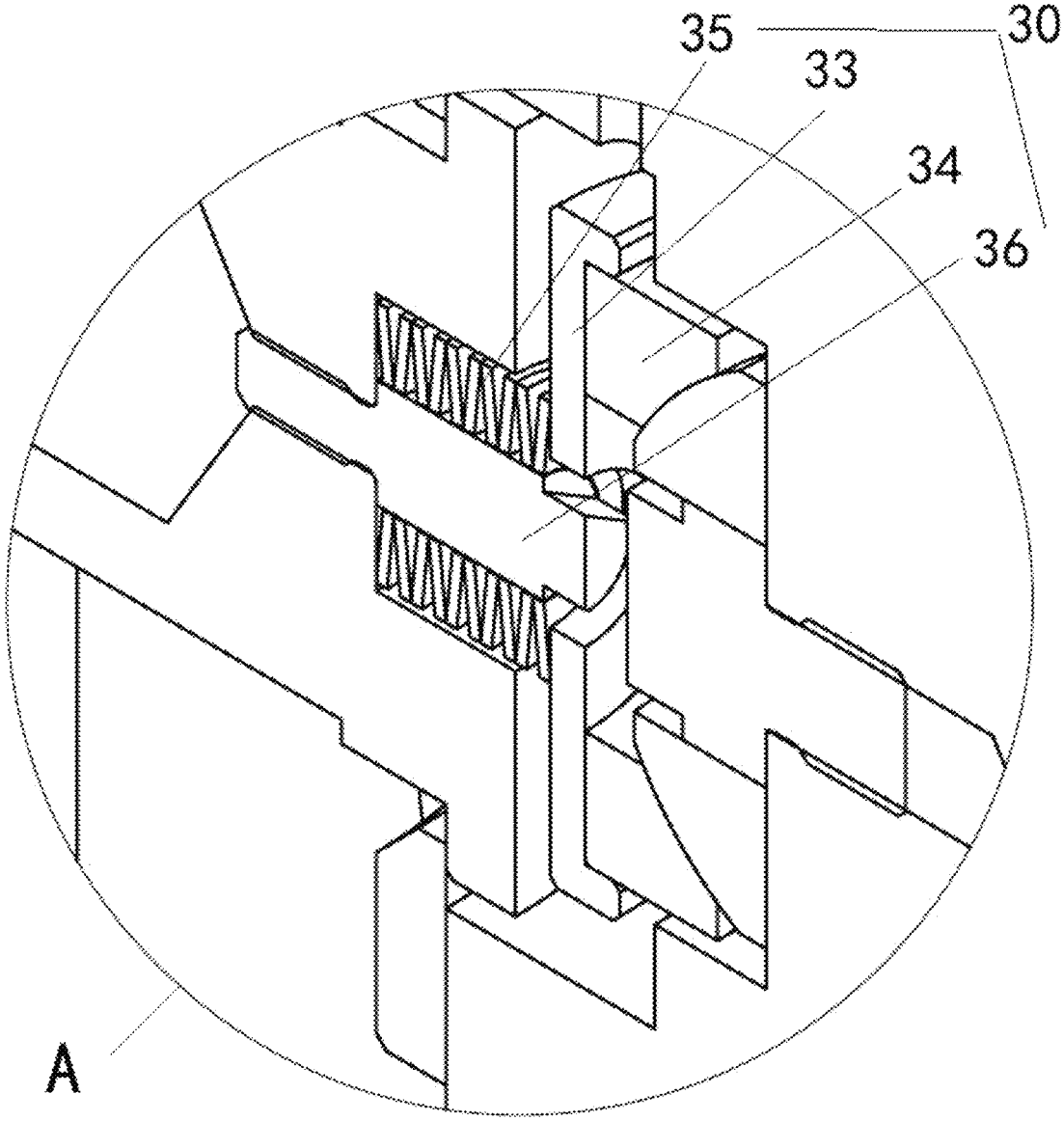
FIG. 3 is an enlarged view of A shown in FIG. 2.
Figure 4:
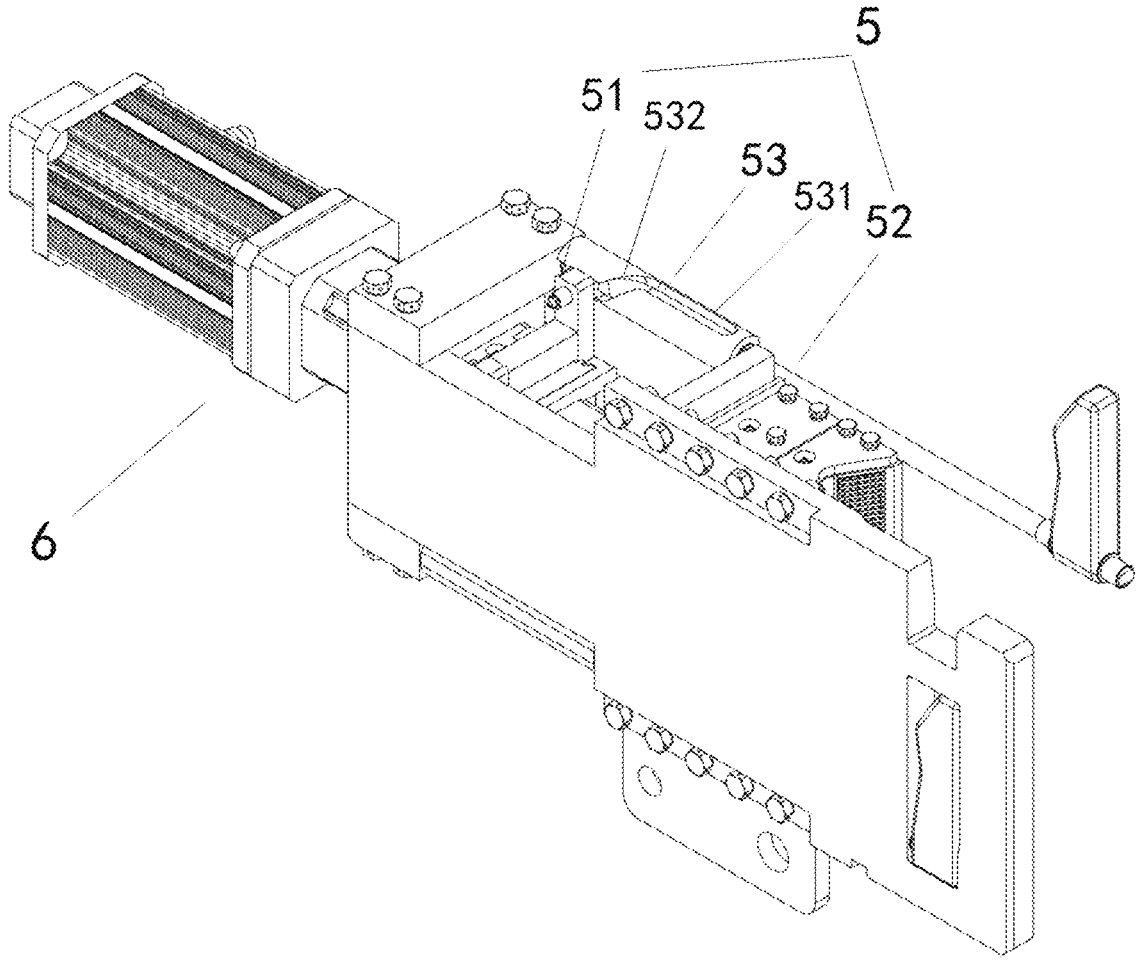
FIG. 4 is a partial structural diagram of the pipe clamping mechanism for oil and gas drilling according to Embodiment 1 of the present disclosure.

Furthermore, considering an actual working condition, when the pipe enters the clamping channel in a non-vertical state, there will be a gap between the tong plate assembly 38 and the pipe, causing the pipe to fall. As shown in FIGS. 3 and 5, an adaptive assembly 30 is provided between the slider mounting seat 31 and the transmission assembly 4 to perform displacement compensation between the tong plate assembly 38 and the pipe when the pipe tilts, such that the tong plate assembly 38 completely locks the pipe to avoid the above situation. Specifically, the adaptive assembly 30 includes connecting rod 32, stopper 33, thrust joint bearing 34, and multiple disc springs 35. The stopper 33 is located between the transmission assembly 4 and the slider mounting seat 31. The connecting rod 32 is threaded through the stopper 33 and connects the transmission assembly 4 and the slider mounting seat 31. The thrust joint bearing 34 and the multiple disc springs 35 are sleeved on the connecting rod 32. The thrust joint bearing 34 is located between the stopper 33 and the slider mounting seat 31. The multiple disc springs 35 are located between the stopper 33 and the transmission assembly 4. The thrust joint bearing 34 keeps the slider mounting seat 31, the tong plate assembly 38, and the pipe relatively stationary when the pipe tilts, avoiding situations such as jamming and loose clamping. The multiple disc springs are configured for displacement compensation between the tong plate assembly 38 and the pipe.

Furthermore, as shown in FIGS. 2 and 5, the transmission assembly 4 includes moving element 41 and push rod 42. The moving element 41 is connected to the clamping assembly 3 through the push rod 42. The moving element 41 is movable forward and backward on the driving assembly 6. The driving assembly 6 drives the moving element 41 to move the clamping assembly 3 forward and backward through the push rod 42. Furthermore, the driving assembly 6 includes driver 61 and driving element 62. The driver 61 is provided at a rear end of the housing 1, and the driver 61 is connected to the transmission assembly 4 through the driving element 62. Specifically, in this embodiment, the driver 61 is a motor, and the driving element 62 is a screw connected to a drive shaft of the motor. The moving element 41 is screwed onto the screw, and the motor drives the screw to rotate, thereby driving the moving element 41 to move forward and backward along the screw.

Furthermore, as shown in FIGS. 2 and 3 to 6, the opening and closing assembly 5 includes lever connecting frame 51 and baffle rotating shaft 52. The baffle rotating shaft 52 is rotatably provided on the housing 1, with an axis of rotation oriented laterally. One end of the baffle rotating shaft 52 is connected to the baffle 2. The moving element 41 of the transmission assembly 4 is connected to the baffle rotating shaft 52 through the lever connecting frame 51. The driver 61 of the driving assembly 6 drives the moving element 41 of the transmission assembly 4 through the driving element 62, thereby driving the lever connecting frame 51 to move forward and backward. The lever connecting frame 51 drives, through the baffle rotating shaft 52, the baffle 2 to rotate in the vertical plane. The baffle rotating shaft 52 is provided with limit groove 53 extending along an axial direction. The limit groove 53 includes a linear groove 531 and a quadrant spiral groove 532 that communicate with each other. The lever connecting frame 51 is slidably connected inside the limit groove 53. The driver 61 drives the moving element 41 through the driving element 62, thereby moving the lever connecting frame 51 forward and backward. When the lever connecting frame 51 slides along the linear groove 531 to the spiral groove 532, it drives the baffle rotating shaft 52 to rotate 90°.

Embodiment 2

This embodiment provides a robot for oil and gas drilling, including the pipe clamping mechanism and the robotic arm assembly described in Embodiment 1. Specifically, the housing 1 of the pipe clamping mechanism is provided on the robotic arm assembly.

The usage of the robot provided in this embodiment is as follows. According to the position of the pipe, the robotic arm assembly drives the pipe clamping mechanism to fully insert the pipe into the clamping channel. The motor drives the screw to rotate, and the screw drives the moving element 41 to move forward along the screw. When the moving element 41 drives the lever connecting frame 51 to slide along the linear groove 531 to the spiral groove 532, the baffle rotating shaft 52 drives the baffle 2 to rotate 90° from the vertical state to the horizontal state in the vertical plane, thereby closing the clamping channel. Meanwhile, the moving element 41 pushes the slider mounting seat 31 and the tong plate assembly 38 forward along the clamping channel through the push rod 42, such that the tong plates 37 abut against the rear side of the pipe and pushes the front side of the pipe to abut against the baffle 2. The mechanical arm assembly drives the mechanism to rise as a whole. The support 36 slides down along the mounting groove 311, and the two clamp lift springs are compressed. Thus, the pipe is clamped by the tong plates 37 and the baffle 2. The process of releasing the pipe is opposite to the above process, and will not be further elaborated here.

Embodiment 3

This embodiment provides a robot for oil and gas drilling, including the pipe clamping mechanism described in Embodiment 1, a telescopic arm assembly, a moving and rotation assembly, and a lifting monkey board assembly. The housing 1 is provided at one end of the telescopic arm assembly, and the other end of the telescopic arm assembly can move horizontally at a bottom of the lifting monkey board assembly through the moving and rotation assembly. The lifting monkey board assembly can drive, through the moving and rotation assembly, the telescopic arm assembly to move up or down vertically, and the lifting monkey board assembly is provided on the derrick.

Specifically, the lifting monkey board assembly is provided on the derrick to replace the monkey board of a traditional racking platform. The telescopic arm assembly can horizontally move at the bottom of the lifting monkey board assembly through the moving and rotation assembly, without occupying the working space on the lifting monkey board assembly. The moving and rotation assembly achieves horizontal movement and angular rotation of the telescopic arm assembly. The lifting monkey board assembly can drive the telescopic arm assembly to move up or down vertically, allowing maintenance personnel to directly perform maintenance on the lifting monkey board assembly. The lifting monkey board assembly can also reduce the working height to improve convenience. Compared to the prior art, the multifunctional robot can make reasonable use of the limited space on the monkey board without affecting its use and fully meeting the requirements of angle and vertical and horizontal displacement. It is convenient for on-site maintenance in the later stage and achieves a simple and compact structure. In addition, the lifting monkey board assembly can directly replace the monkey board of the traditional racking platform, which is suitable for the transformation of new and old oil drilling rigs.

Furthermore, as shown in the figure, sliding mechanism 12 and push-support clamp mechanism 13 are further provided above the housing 1 of the pipe clamping mechanism. The sliding mechanism 12 includes slide rail 121, sliding seat 122, and sliding driver 123. The slide rail 121 is provided at a top of gripping clamp mechanism 11. The push-support clamp mechanism 13 is slidably provided on the slide rail 121 through the sliding seat 122. The sliding driver 123 is provided on the slide rail 121. The sliding driver 123 is connected to the sliding seat 122 and configured to drive the sliding seat 122 to move the push-support clamp mechanism 13 along the slide rail 121. The sliding mechanism 12 can drive the push-support clamp mechanism 13 from a standby position to a working position during a push-support operation. After the push-support operation is completed, the sliding mechanism 12 drives the push-support clamp mechanism 13 from the working position to the standby position. Therefore, the push-support clamp mechanism 13 and the gripping clamp mechanism 11 do not interfere with each other.

Figure 9:
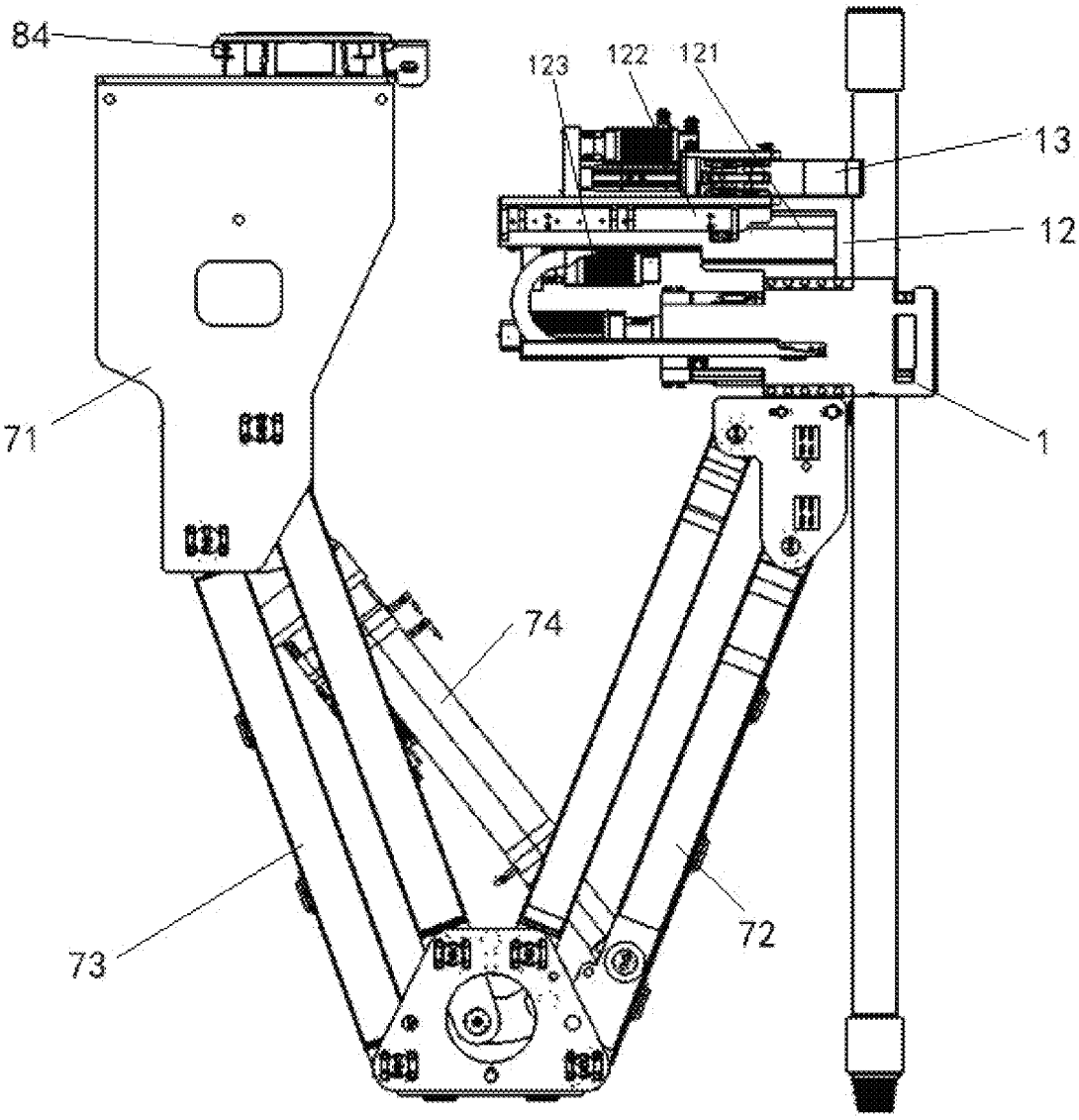
FIG. 9 is a structural diagram showing that a telescopic arm assembly and the pipe clamping mechanism clamp a pipe according to Embodiment 3 of the present disclosure.

Furthermore, as shown in FIG. 9, the telescopic arm assembly 7 includes support 71, telescopic front arm 72, telescopic rear arm 73, and telescopic driver 74. A first end of the telescopic front arm 72 is connected to clamp assembly 1, and a second end of the telescopic front arm 72 is rotatably connected to a first end of the telescopic rear arm 73. A second end of the telescopic rear arm 73 is rotatably provided on the support 71. The telescopic driver 74 is provided on a frame. The telescopic driver 74 is connected to the telescopic front arm 72 and configured to drive the telescopic front arm 72 and the telescopic rear arm 73 to rotate in a horizontal plane to achieve extension and retraction. The support 71 can move horizontally on the lifting monkey board assembly 9 through the moving and rotation assembly 8.

Figure 8:
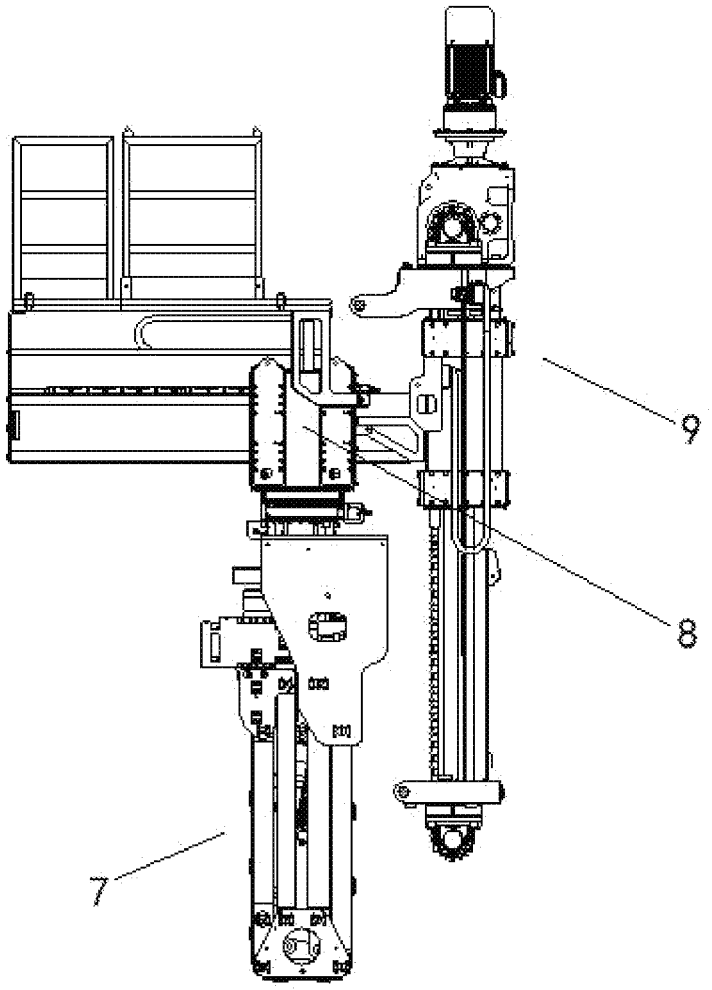
FIG. 8 is a front view of a robot for oil and gas drilling according to Embodiment 3 of the present disclosure.
Figure 10:
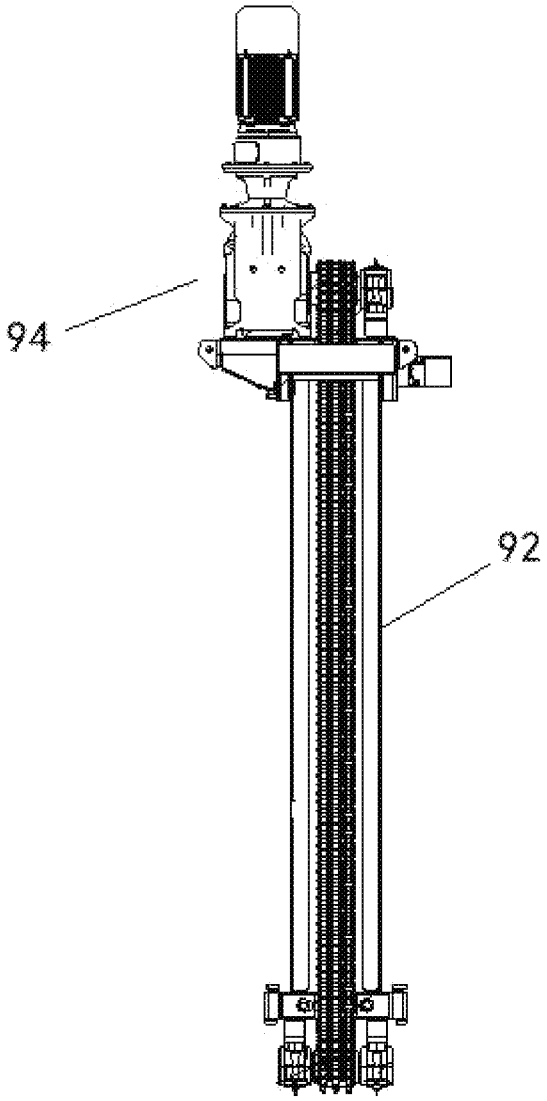
FIG. 10 is a partial structural diagram of a lifting mechanism according to Embodiment 3 of the present disclosure.
Figure 11:
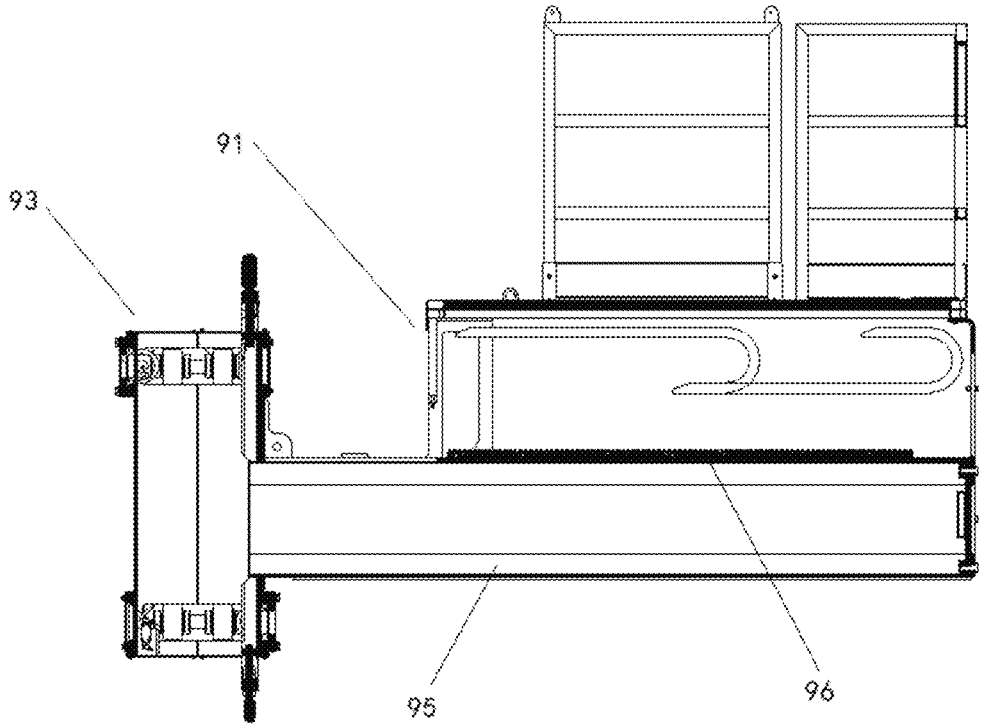
FIG. 11 is a structural diagram of a monkey board and a lifting seat according to Embodiment 3 of the present disclosure.

Furthermore, as shown in FIGS. 8, 10, and 11, the lifting monkey board assembly 9 includes a lifting mechanism and monkey board 91. The lifting mechanism is fixedly provided on a derrick, and the monkey board 91 is provided on the lifting mechanism. The lifting mechanism drives the monkey board 91 to move up or down vertically. The moving and rotation assembly 8 is movably provided at a bottom of the monkey board 91. Specifically, the lifting mechanism includes standing post 92, a mounting assembly, lifting seat 93, and lift driving assembly 94. The standing post 92 is provided on the derrick through the mounting assembly. The lifting seat 93 is movable up and down on the standing post 92. The monkey board 91 is provided on the lifting seat 93. The lift driving assembly 94 is provided on the standing post 92. The lift driving assembly 94 is connected to the lifting seat 93 and configured to drive the lifting seat 93 to move the monkey board 91 up or down vertically along the standing post 92.

Figure 12:
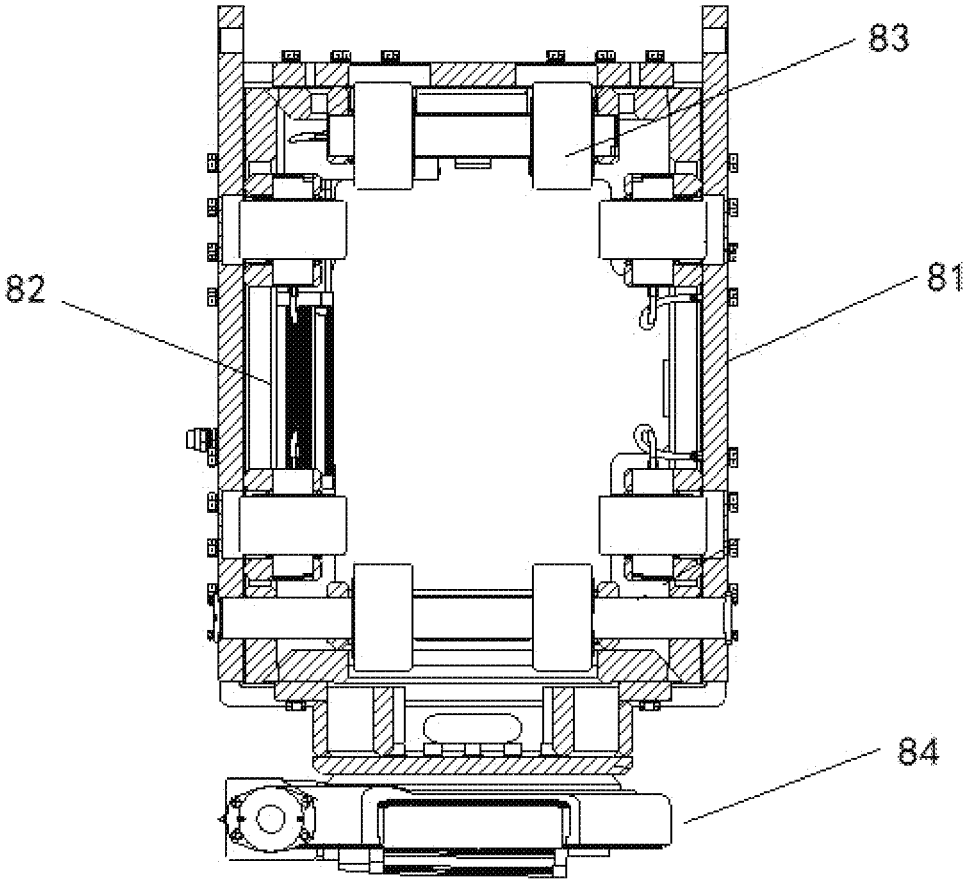
FIG. 12 is a structural diagram of a moving and rotation assembly according to Embodiment 3 of the present disclosure.
Figure 13:
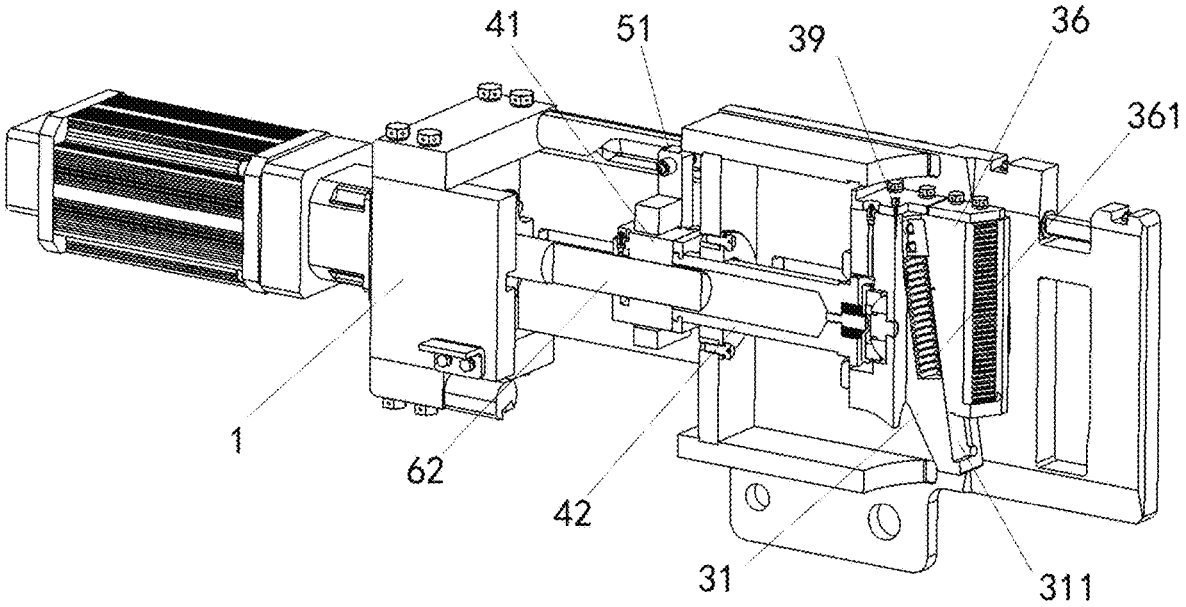
FIG. 13 is a section view of the pipe clamping mechanism for oil and gas drilling according to Embodiment 1 of the present disclosure, in which reset assembly is shown.

Furthermore, as shown in FIGS. 11 and 12, the bottom of the lifting monkey board assembly 9 is provided with guide rail 95 extending in a front-to-rear direction. Specifically, the bottom of the monkey board 91 is provided with the guide rail 95 extending in the front-to-rear direction. The guide rail 95 is provided with rack 96 extending along a length direction thereof. The moving and rotation assembly 8 includes traveling support 81, traveling driver 82, a gear, multiple sets of traveling rollers 83, and rotary driver 84. The telescopic arm assembly 7 is provided at a bottom of the traveling support 81 through the rotary driver 84. The traveling support 81 is sleeved on the guide rail 95. The multiple sets of traveling rollers 83 are supported between the traveling support 81 and the guide rail 95. The traveling driver 82 is provided on the traveling support 81. The traveling driver 82 is connected in a transmission manner to the rack 96 through the gear and configured to drive the gear to mesh with the rack 96 and move the traveling support 81 along the guide rail 95.

A usage of the multifunctional robot provided in this embodiment is as follows. During a drilling operation, according to a storage position of a pipe on a racking platform, the traveling driver 82 drives the gear to mesh with the rack 96, thereby moving the traveling support 81 along the guide rail 95 and driving the telescopic arm assembly 7 to move to a designated position. The angle of the telescopic arm assembly 7 is adjusted through the rotary driver 84. According to a coupling height of the pipe, the lift driving assembly 94 drives the lifting seat 93 to adjust the height of the telescopic arm assembly 7 through the monkey board 91. The telescopic arm assembly 7 drives the pipe clamping mechanism to approach the pipe. Before clamping, the gripping method of the gripping clamp mechanism 11 or the push-support method of the push-support clamp mechanism 13 is selected according to the weight of the pipe. The lifting monkey board assembly 9 drives the telescopic arm assembly 7 to lift the pipe, causing the pipe to detach from the storage position. The moving and rotation mechanism and the telescopic arm assembly 7 move the pipe to a handover position and hand it over to a traveling block system. In this way, the traveling block system and drilling platform equipment complete the drilling operation. The process of tripping in is opposite to the process of tripping out, and will not be further elaborated here.

It should be understood that in the description of the present disclosure, terms such as "first" and "second" are used merely for a descriptive purpose, and should not be construed as indicating or implying relative importance, or implicitly indicating the number of indicated technical features. Thus, features defined with "first" and "second" may explicitly or implicitly include one or more of the features. In the description of the present disclosure, "a plurality of" means two or more, unless otherwise specifically defined.

In the present disclosure, unless otherwise clearly specified, the terms "installation", "interconnection", "connection" and "fixation" etc. are intended to be understood in a broad sense. For example, the "connection" may be a fixed connection, removable connection or integral connection;

may be a mechanical connection or electrical connection; may be a direct connection or indirect connection using a medium; and may be a communication or interaction between two elements. Those of ordinary skill in the art may understand specific meanings of the above terms in the present disclosure based on a specific situation.

In the present disclosure, unless otherwise explicitly specified, when it is described that a first feature is "above" or "below" a second feature, it indicates that the first and second features are in direct contact or the first and second features are in indirect contact through an intermediate feature. In addition, when it is described that the first feature is "over", "above" and "on" the second feature, it indicates that the first feature is directly or obliquely above the second feature, or simply indicates that an altitude of the first feature is higher than that of the second feature. When it is described that a first feature is "under", "below" or "beneath" a second feature, it indicates that the first feature is directly or obliquely under the second feature or simply indicates that the first feature is lower than the second feature.

In the description of this specification, the description with reference to the terms such as "one embodiment", "some embodiments", "example", "specific example" or "some examples" means that specific features, structures, materials or characteristics described in connection with the embodiment or example are included in at least one embodiment or example of the present disclosure. In this specification, the schematic expression of the above terms is not necessarily directed to the same embodiment or example. Moreover, the specific features, structures, materials, or characteristics described may be combined in a suitable manner in any one or more embodiments or examples. In addition, those skilled in the art may combine different embodiments or examples described in this specification and characteristics of the different embodiments or examples without mutual contradiction.

Although the embodiments of the present disclosure have been illustrated and described above, it will be appreciated that the above embodiments are illustrative and should not be construed as limiting the present disclosure. Changes, modifications, substitutions, and variations can be made to the above embodiments by a person of ordinary skill in the art within the scope of the present disclosure.

What is claimed is:

1. A pipe clamping mechanism for oil and gas drilling, comprising:

a housing, a baffle, a clamping assembly, a transmission assembly, an opening and closing assembly, and a driving assembly, wherein the housing is provided with a pipe clamping channel extending in a front-to-rear direction; the baffle is rotatably provided on the housing; the driving assembly and the opening and closing assembly are provided on the housing; the driving assembly is connected to the opening and closing assembly; and the opening and closing assembly is further connected to the baffle;

the clamping assembly is movable forward and backward on the housing; the driving assembly is connected to the clamping assembly through the transmission assembly; and the driving assembly drives, through the transmission assembly, the clamping assembly to move forward and backward, and simultaneously drive the opening and closing assembly to rotate the baffle in a vertical plane, wherein the pipe clamping channel is opened or closed; and the housing is provided on a robotic arm assembly, wherein the clamping assembly comprises a slider mounting seat, a tong plate assembly, and a reset assembly;

the slider mounting seat is slidable forward and backward inside the housing; the slider mounting seat is connected to the transmission assembly; a front end of the slider mounting seat is provided with a mounting groove, wherein the mounting groove inclines backwards from top to bottom; the tong plate assembly is provided with a mounting surface, wherein the mounting surface inclines backwards from top to bottom; the mounting surface matches the mounting groove in terms of inclination angle; and the tong plate assembly is slidably provided in the mounting groove through the mounting surface; and the reset assembly is provided between the mounting groove and the tong plate assembly, wherein after clamping work is completed, the tong plate assembly returns to an initial position.

2. The pipe clamping mechanism for the oil and gas drilling according to claim 1, wherein an adaptive assembly is provided between the slider mounting seat and the transmission assembly to perform displacement compensation between the tong plate assembly and a pipe when the pipe tilts.

3. The pipe clamping mechanism for the oil and gas drilling according to claim 2, wherein the adaptive assembly comprises a connecting rod, a stopper, a thrust joint bearing, and multiple disc springs; and the stopper is located between the transmission assembly and the slider mounting seat; the connecting rod is threaded through the stopper and connects the transmission assembly and the slider mounting seat; the thrust joint bearing and the multiple disc springs are sleeved on the connecting rod; the thrust joint bearing is located between the stopper and the slider mounting seat; and the multiple disc springs are located between the stopper and the transmission assembly.

4. The pipe clamping mechanism for the oil and gas drilling according to claim 1, wherein the tong plate assembly comprises a support and at least one tong plate; and the at least one tong plate is provided on the support; the support is provided in the mounting groove; and the reset assembly is provided between the mounting groove and the support.

5. The pipe clamping mechanism for the oil and gas drilling according to claim 1, wherein the transmission assembly comprises a moving element and a push rod; and the moving element is connected to the clamping assembly through the push rod; the moving element is movable forward and backward on the driving assembly; and the driving assembly drives the moving element to move the clamping assembly forward and backward through the push rod.

6. The pipe clamping mechanism for the oil and gas drilling according to claim 1, wherein the opening and closing assembly comprises a lever connecting frame and a baffle rotating shaft;

the baffle rotating shaft is rotatably provided on the housing, with an axis of rotation oriented laterally; one end of the baffle rotating shaft is connected to the baffle; and the transmission assembly is connected to the baffle rotating shaft through the lever connecting frame; and the driving assembly drives, through the transmission assembly, the lever connecting frame to move forward and backward; and the lever connecting frame is configured to drive, through the baffle rotating shaft, the baffle to rotate in the vertical plane.

7. The pipe clamping mechanism for the oil and gas drilling according to claim 6, wherein the baffle rotating shaft is provided with a limit groove extending along an axial direction; the limit groove comprises a linear groove and a spiral groove, wherein the linear groove and the spiral groove communicate with each other; the lever connecting frame is slidably connected inside the limit groove; the driving assembly is configured to drive, through the transmission assembly, the lever connecting frame to move forward and backward; and when the lever connecting frame slides along the linear groove to the spiral groove, the lever connecting frame drives the baffle rotating shaft to rotate.

8. A robot for oil and gas drilling, comprising the pipe clamping mechanism for the oil and gas drilling according to claim 1, wherein the robot further comprises:

a telescopic arm assembly, a moving and rotation assembly, and a lifting monkey board assembly;

wherein the housing is provided at a first end of the telescopic arm assembly, and a second end of the telescopic arm assembly is movable horizontally at a bottom of the lifting monkey board assembly through the moving and rotation assembly; the lifting monkey board assembly drives, through the moving and rotation assembly, the telescopic arm assembly to move up or down vertically; and the lifting monkey board assembly is provided on a derrick.

9. The robot for the oil and gas drilling according to claim 8, wherein in the pipe clamping mechanism, the clamping assembly comprises a slider mounting seat, a tong plate assembly, and a reset assembly;

the slider mounting seat is slidable forward and backward inside the housing; the slider mounting seat is connected to the transmission assembly; a front end of the slider mounting seat is provided with a mounting groove, wherein the mounting groove inclines backwards from top to bottom; the tong plate assembly is provided with a mounting surface, wherein the mounting surface inclines backwards from top to bottom; the mounting surface matches the mounting groove in terms of inclination angle; and the tong plate assembly is slidably provided in the mounting groove through the mounting surface; and the reset assembly is provided between the mounting groove and the tong plate assembly, wherein after clamping work is completed, the tong plate assembly returns to an initial position.

10. The robot for the oil and gas drilling according to claim 8, wherein in the pipe clamping mechanism, an adaptive assembly is provided between the slider mounting seat and the transmission assembly to perform displacement compensation between the tong plate assembly and a pipe when the pipe tilts.

11. The robot for the oil and gas drilling according to claim 10, wherein in the pipe clamping mechanism, the adaptive assembly comprises a connecting rod, a stopper, a thrust joint bearing, and multiple disc springs; and the stopper is located between the transmission assembly and the slider mounting seat; the connecting rod is threaded through the stopper and connects the transmission assembly and the slider mounting seat; the thrust joint bearing and the multiple disc springs are sleeved on the connecting rod; the thrust joint bearing is located between the stopper and the slider mounting seat; and the multiple disc springs are located between the stopper and the transmission assembly.

12. The robot for the oil and gas drilling according to claim 8, wherein in the pipe clamping mechanism, the tong plate assembly comprises a support and at least one tong plate; and the at least one tong plate is provided on the support; the support is provided in the mounting groove; and the reset assembly is provided between the mounting groove and the support.

13. The robot for the oil and gas drilling according to claim 8, wherein in the pipe clamping mechanism, the transmission assembly comprises a moving element and a push rod; and the moving element is connected to the clamping assembly through the push rod; the moving element is movable forward and backward on the driving assembly; and the driving drives the moving element to move the clamping assembly forward and backward through the push rod.

14. The robot for the oil and gas drilling according to claim 8, wherein in the pipe clamping mechanism, the opening and closing assembly comprises a lever connecting frame and a baffle rotating shaft;

the baffle rotating shaft is rotatably provided on the housing, with an axis of rotation oriented laterally; one end of the baffle rotating shaft is connected to the baffle; and the transmission assembly is connected to the baffle rotating shaft through the lever connecting frame; and the driving assembly drives, through the transmission assembly, the lever connecting frame to move forward and backward; and the lever connecting frame is configured to drive, through the baffle rotating shaft, the baffle to rotate in the vertical plane.

15. The robot for the oil and gas drilling according to claim 14, wherein in the pipe clamping mechanism, the baffle rotating shaft is provided with a limit groove extending along an axial direction; the limit groove comprises a linear groove and a spiral groove, wherein the linear groove and the spiral groove communicate with each other; the lever connecting frame is slidably connected inside the limit groove; the driving assembly is configured to drive, through the transmission assembly, the lever connecting frame to move forward and backward; and when the lever connecting frame slides along the linear groove to the spiral groove, the lever connecting frame drives the baffle rotating shaft to rotate.

* * * * *